US008579596B2

(12) United States Patent
Huntley

(10) Patent No.: US 8,579,596 B2
(45) Date of Patent: Nov. 12, 2013

(54) EJECTOR PUMP

(75) Inventor: Graeme Huntley, Newport (GB)

(73) Assignee: Edwards Limited (GB)

( * ) Notice: Subject to any disclaimer, the term of this patent is extended or adjusted under 35 U.S.C. 154(b) by 1136 days.

(21) Appl. No.: 11/883,896

(22) PCT Filed: Jan. 12, 2006
(Under 37 CFR 1.47)

(86) PCT No.: PCT/GB2006/000106

§ 371 (c)(1),
(2), (4) Date: Oct. 6, 2009

(87) PCT Pub. No.: WO2006/082357

PCT Pub. Date: Aug. 10, 2006

(65) Prior Publication Data

US 2012/0148421 A1 Jun. 14, 2012

(30) Foreign Application Priority Data

Feb. 7, 2005 (GB) ..... 0502495.5

(51) Int. Cl.
*F04B 23/08* (2006.01)
*F04F 5/00* (2006.01)

(52) U.S. Cl.
USPC ..... 417/87; 417/151

(58) Field of Classification Search
USPC ..... 417/85, 151, 87, 163, 174, 198
See application file for complete search history.

(56) References Cited

U.S. PATENT DOCUMENTS 3,594,609 A * 7/1971 Vas ..... 315/111.41
3,692,431 A * 9/1972 Gebel ..... 417/183
3,729,611 A * 4/1973 Vas ..... 219/121.36
7,075,030 B2 * 7/2006 Hershcovitch et al. .. 219/121.36
2004/0229419 A1 * 11/2004 Namose ..... 438/202
2005/0089408 A1 * 4/2005 Solomon ..... 417/182
2006/0131282 A1 * 6/2006 Miller et al. ..... 219/121.5

FOREIGN PATENT DOCUMENTS

| | | | |
|---|---|---|---|
| DE | 10115241 | A1 * | 3/2001 |
| DE | 101 15 241 | A1 | 10/2002 |
| EP | 1 460 271 | A1 | 9/2004 |
| EP | 1460271 | A1 * | 9/2004 |
| SU | 758812 | A1 | 1/1989 |
| SU | 1 605 094 | A1 | 11/1990 |
| SU | 1 738 870 | A1 | 6/1992 |
| TW | 464918 | | 11/2001 |
| WO | 00/41445 | | 7/2000 |

(Continued)

OTHER PUBLICATIONS

English Translations of EP 1,460,271 and DE 10,115,241.*

(Continued)

*Primary Examiner* — Charles Freay
*Assistant Examiner* — Alexander Comley
(74) *Attorney, Agent, or Firm* — Shumaker & Sieffert, P.A.

(57) ABSTRACT

An ejector pump (100) includes a chamber having a gas mixing portion (108) and a diffuser portion (112). An inlet (10S) conveys a gas stream into the gas mixing portion, and an outlet (114) conveys the gas stream from the diffuser portion. To provide a motive fluid for the pump, a stream of plasma is ejected through a nozzle (116) into the gas mixing portion (108) of the chamber. Reactive species contained within the plasma stream react with a component of the gas stream to provide simultaneous pumping and abatement of the gas stream.

15 Claims, 5 Drawing Sheets

(56) References Cited

FOREIGN PATENT DOCUMENTS

| | | | |
|---|---|---|---|
| WO | 01/80281 | A2 | 10/2001 |
| WO | 01/80281 | A3 | 10/2001 |
| WO | 03/058069 | A2 | 7/2003 |

OTHER PUBLICATIONS

Gesche Roland, Kovacs Reinhold, Tobies Harald, Wette Frank; abstract of DE 10115241 A1, entitled "Plasma Torch for Treating Surfaces at Atmospheric Pressure Includes a Jet Pump within Torch to Provide Low Pressure Region"; Oct. 24, 2002; Aurion Anlagentechnik GmbH.

United Kingdom Search Report of Application No. GB 0502495.5; Claims searched: 1-19; Date of search: May 24, 2005.

PCT Notification of Transmittal of the International Search Report and the Written Opinion of the International Searching Authority, or the Declaration of International Application No. PCT/GB2006/000106; Date of mailing: Apr. 3, 2006.

PCT International Search Report of International Application No. PCT/GB2006/000106; Date of Mailing of the International Search Report: Apr. 3, 2006.

PCT Written Opinion of the International Searching Authority of International Application No. PCT/GB2006/000106; Date of mailing: Apr. 3, 2006.

* cited by examiner

EJECTOR PUMP

The present invention relates to an ejector pump, and to a pumping arrangement comprising an ejector pump.

Ejector pumps are an established technology for pumping gases over a range of pressures. Within the ejector pump, the gas to be pumped becomes entrained within a high velocity stream of air or other motive fluid at a relatively low pressure, and transported through an orifice into a relatively high pressure region of the to pump.

With reference to FIG. 1, a known ejector pump 10 comprises a main body 12 provided in fluid communication with a suction chamber 14 having an inlet 16 for receiving a gas to be pumped. The suction chamber 14 houses a nozzle 18 for receiving a stream of motive fluid and ejecting the stream at high velocity into the suction chamber 14. The increase in the velocity of the stream of motive fluid as it is ejected from the nozzle generates a low pressure, or vacuum, within the suction chamber 14, which causes gas to be drawn through the inlet 16 and become entrained within the stream of motive fluid flowing from the nozzle 18, into the main body 12 of the pump 10. The main body 12 comprises three main portions, a converging mixing portion 20, a throat portion 22 and a diverging diffuser portion 24 leading to an outlet 26 of the pump 10. The gas mixes with the motive fluid with the mixing portion 20, passes through the throat portion 22 and enters the diffuser portion 24, wherein the velocity of the mixed stream is reduced, thereby increasing its pressure. This enables the pump 10 to exhaust gas from the outlet 26 at a higher pressure than the gas entering the pump 10 from the inlet 16, and so the ejector pump 10 is thus capable of boosting the pressure of the gas passing therethrough.

An ejector pump can be used as part of an exhaust system for pumping a wide variety of gases. PFC gases such as $CF_4$, $C_2F_6$, $C_3F_8$, $NF_3$ and $SF_6$ are commonly used in the semiconductor manufacturing industry, for example, in dielectric film etching. Following the manufacturing process there is typically a residual PFC content in the gas pumped from the process tool, and so the PFC gases require treatment in a separate abatement tool to convert the PFCs into one or more compounds that can be more conveniently disposed of, for example, by conventional scrubbing. This can significantly increase the cost of the exhaust system.

It is an aim of at least the preferred embodiment of the present invention to provide a pumping arrangement that can provide both pumping and abatement of a gas to stream.

SUMMARY OF THE INVENTION

In a first aspect, the present invention provides a pumping arrangement comprising an ejector pump and a backing pump, wherein the ejector pump comprises a chamber having a gas mixing portion and a diffuser portion, an inlet is for conveying a gas stream into the gas mixing portion, an outlet for conveying the gas stream from the diffuser portion, and a gas abatement device for ejecting a stream of plasma through a nozzle into the gas mixing portion of the chamber to provide a motive fluid for the pump and decompose a component of the gas stream, and wherein the backing pump has an inlet connected to the outlet of the ejector pump.

In a second aspect the present invention, an ejector pump is provided comprising a chamber having a gas mixing portion and a diffuser portion, a first inlet for conveying a gas stream into the gas mixing portion, an outlet for conveying the gas stream from the diffuser portion, a second inlet for receiving a stream of reactive fluid, and a device for ejecting a stream of plasma through a nozzle into the gas mixing portion of the chamber to provide a motive fluid for the pump and within which the reactive fluid stream becomes entrained to form reactive species for reacting with the component of the gas stream. In a third aspect, the present invention provides a pumping arrangement comprising an ejector pump as aforementioned.

BRIEF DESCRIPTION OF THE DRAWINGS

The present invention will now be described with reference to the accompanying drawing, in which.

DETAILED DESCRIPTION OF THE INVENTION

Figure 1:
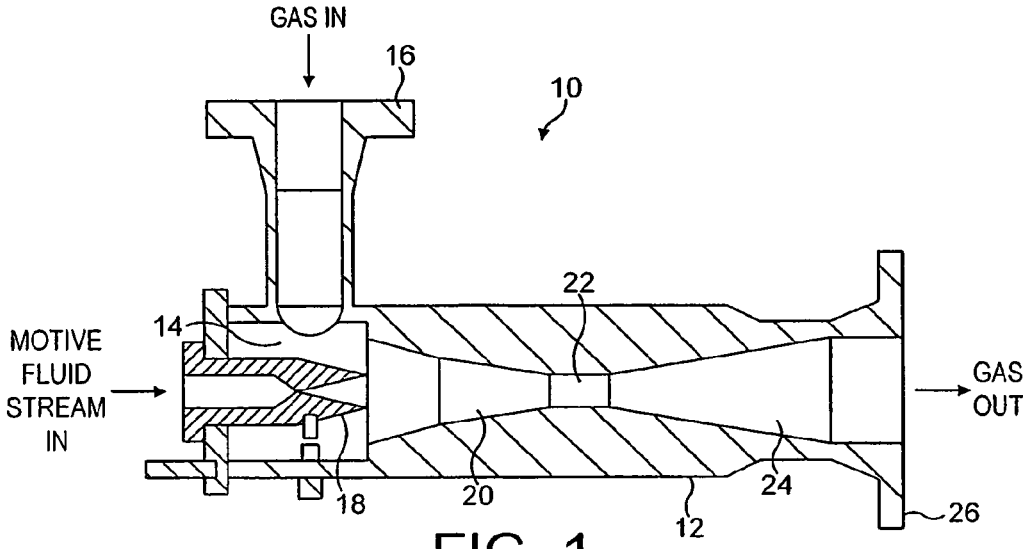
FIG. 1 (PRIOR ART)
FIG. 1 illustrates schematically a known ejector pump.

In a first aspect, the present invention provides a pumping arrangement comprising an ejector pump and a backing pump, wherein the ejector pump comprises a chamber having a gas mixing portion and a diffuser portion, an inlet for conveying a gas stream into the gas mixing portion, an outlet for conveying the gas stream from the diffuser portion, and a gas abatement device for ejecting a stream of plasma through a nozzle into the gas mixing portion of the chamber to provide a motive fluid for the pump and decompose a component of the gas stream, and wherein the backing pump has an inlet connected to the outlet of the ejector pump.

The gas stream entering the inlet thus becomes entrained within the plasma stream and conveyed through the chamber towards the outlet. Under the intensive conditions within the plasma, one or more components within the gas stream are subjected to impact with energetic electrons causing dissociation of those components into reactive components of the gas stream. These components can react with one or more reactive species added to the plasma stream, or with reactive species already present within the plasma stream, to produce relatively stable, low molecular weight by-products that can be readily removed from the gas stream in a subsequent treatment.

The pumping arrangement preferably further comprises a booster pump having an outlet connected to the inlet of the ejector pump. When used in combination with other components of the pumping arrangement, such as a booster pump and/or a backing pump, the ejector pump may either reduce the number of pumping stages required for the booster pump, and/or reduce the capacity requirement of the backing pump.

The backing pump may be advantageously provided by a liquid ring pump. As the gas stream is caused to come into contact with the pumping water of the ring pump, any water-soluble components of the gas stream are washed into the pumping water and thus removed from the gas stream before it is exhaust, at or around atmospheric pressure, from the pump. For example, compounds such as $CF_4$, $C_2F_6$, $CHF_3$, $C_3F_8$, and $C_4F_8$ can be converted into $CO_2$ and HF within the ejector pump, which can be taken into solution in the liquid ring pump. Other examples are $NF_3$, which can be converted into $N_2$ and HF, and $SF_6$, which can be converted into $SO_2$ and HF.

The liquid ring pump can thus operate as both a wet scrubber and an atmospheric vacuum pumping stage for the gas stream, and so a conventional wet scrubber is no longer required, thereby reducing costs. Furthermore, unlike a Roots or Northey-type pumping mechanism, any particulate or powder by-products contained within the gas stream do not have a detrimental effect on the pumping mechanism of the liquid ring pump, and so there is no requirement to provide any purge gas to the atmospheric pumping stage.

The reactive species are preferably chosen to convert a component of the gas stream into a different compound. For example, one or more components of the gas stream such as $SiH_4$ and/or $NH_3$, may be converted into one or more compounds that are less reactive than said component. Such gases may be present where the ejector pump is configured to receive gas streams exhaust from different process tools, or where different process gases are supplied to a process tool at different times. Conversion of $SiH_4$ and $NH_3$ gases can inhibit the formation of reactive gas mixtures within the gas stream. For example, $SiH_4$ can be treated to form $SiO_2$.

As another example, the reactive species may be chosen to convert a component of the gas stream into a compound that is less reactive than said component with the liquid of a scrubber provided downstream from the ejector pump. For example, whilst $F_2$ is soluble within water, it may react with water to form insoluble compounds, such as $OF_2$. Conversion of $F_2$ into HF within the elector pump can inhibit the formation of such compounds.

In a further example, the reactive species may be chosen to convert one or more water-insoluble components of the gas stream into one or more water-soluble components. Examples of liquid-insoluble compounds are perfluorinated compounds, such as $CF_4$, $C_2F_6$, $CHF_3$, $C_3F_8$, $C_4F_8$, $NF_3$ and $SF_6$, and hydrofluorocarbon compounds.

By providing a technique in which reactive species are formed from a reactive fluid for subsequent reaction with such components of the gas stream, it has been found that the energy required to cause the destruction of the component in the gas stream, and the efficiency of that destruction, can be radically improved. For example, $H^+$ and $OH^-$ ions formed from the dissociation of water are capable of reacting with, for example, a PFC contained in the gas stream at ambient temperature, and thus at a much lower temperature than would be required if the water had not been pre-ionised. Further advantages are that a relatively cheap and readily available fluid, such as water vapour or a fuel, for example methane or an alcohol, can be used to generate $H^+$ and/or $OH^-$ ions, as the reactive species, and that the reaction can take place at sub-atmospheric or atmospheric pressure.

Two different techniques may be used to form the plasma stream using a dc plasma torch. In the first technique, the plasma torch receives a stream of reactive fluid. An electric arc is established between electrodes of the torch and the reactive fluid is conveyed along the arc to generate a plasma flame containing the reactive species. This flame is subsequently ejected into the chamber through the nozzle to form the motive gas for the ejector pump and react with the component of the gas stream.

In the second technique, the plasma is generated from a source gas different from the reactive fluid. For example, an inert ionisable gas, such as nitrogen or argon, can be conveyed along the arc to generate the plasma flame for election into the chamber through the nozzle. A stream of reactive fluid impinges upon the plasma to form the reactive species within the plasma. The reactive fluid may become entrained within the plasma flame upstream from the nozzle, so that a plasma containing the reactive species is ejected from the nozzle. Alternatively, the reactive fluid and the gas stream may be separately conveyed into the chamber through respective inlets, with the reactive fluid becoming entrained within and dissociated by the plasma flame within the gas mixing portion of the chamber to form the reactive species within the chamber, which species subsequently react with the component of the gas stream. Thus, in a second aspect the present invention provides an ejector pump comprising a chamber having a gas mixing portion and a diffuser portion, a first inlet for conveying a gas stream into the gas mixing portion, an outlet for conveying the gas stream from the diffuser portion, a second inlet for receiving a stream of reactive fluid, and a device for ejecting a stream of plasma through a nozzle into the gas mixing portion of the chamber to provide a motive fluid for the pump and within which the reactive fluid stream becomes entrained to form reactive species for reacting with the component of the gas stream. In a third aspect, the present invention provides a pumping arrangement comprising an ejector pump as aforementioned.

In order to improve the operating efficiency of the pump, means may be provided for shaping the plasma stream ejected from the nozzle. For example, a magnetic field may be generated to modify the shape the plasma stream elected from the nozzle independent from the pressure of the gas stream passing through the chamber. A pressure sensor may be provided upstream or downstream from the ejector pump for providing a signal to the shaping means indicative of the pressure of the gas stream, with the shaping means being configured to use the received signal to adjust the size and/or strength of the magnetic field.

Features described above in relation to the first aspect of the invention are equally applicable to the second aspect, and vice versa.

Figure 2:
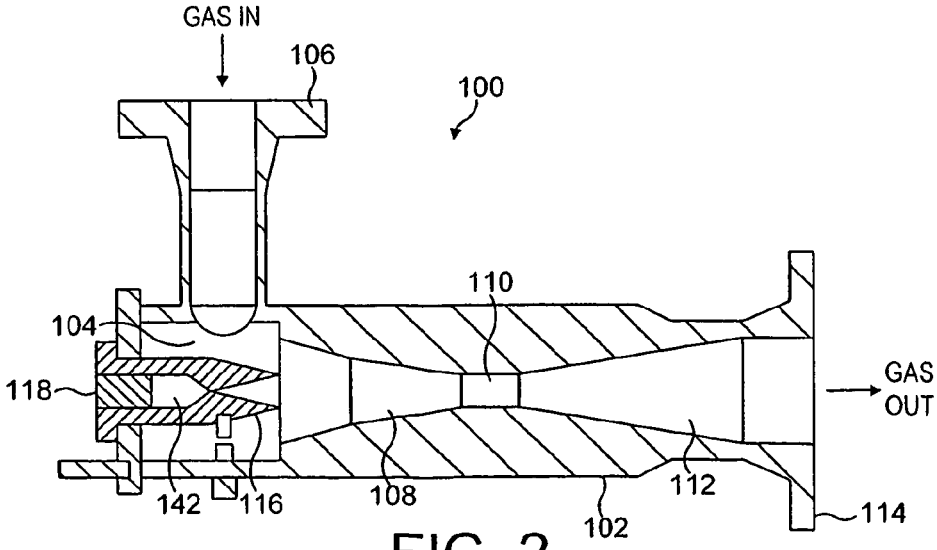
FIG. 2 illustrates schematically an example of an ejector pump according to the present invention.

With reference to FIG. 2, a first example of an ejector pump 100 comprises a main body 102 provided in fluid communication with a suction chamber 104 having an inlet 106 for receiving a gas stream to be pumped. The main body 102 comprises a chamber having three main portions, a converging mixing portion 108 provided adjacent the suction chamber 104, a throat portion 110 and a diverging diffuser portion 112. An outlet 114 conveys the pumped gas stream from the diffuser portion 112 of the ejector pump 100.

A nozzle 116 is located in the suction chamber 104 for ejecting a stream of motive fluid into the mixing portion 108 so that, in use, the gas stream entering the ejector pump 100 through the inlet 106 becomes entrained within the motive fluid, passes through the throat portion 110 and enters the diffuser portion 112, wherein the velocity of the mixed gas stream is reduced, thereby increases its pressure.

In the ejector pump 100 illustrated in FIG. 2, the stream of motive fluid is in the form of a plasma stream ejected from the nozzle 116 for converting one or more of the components of the gas stream into one or more other compounds.

Figure 3:
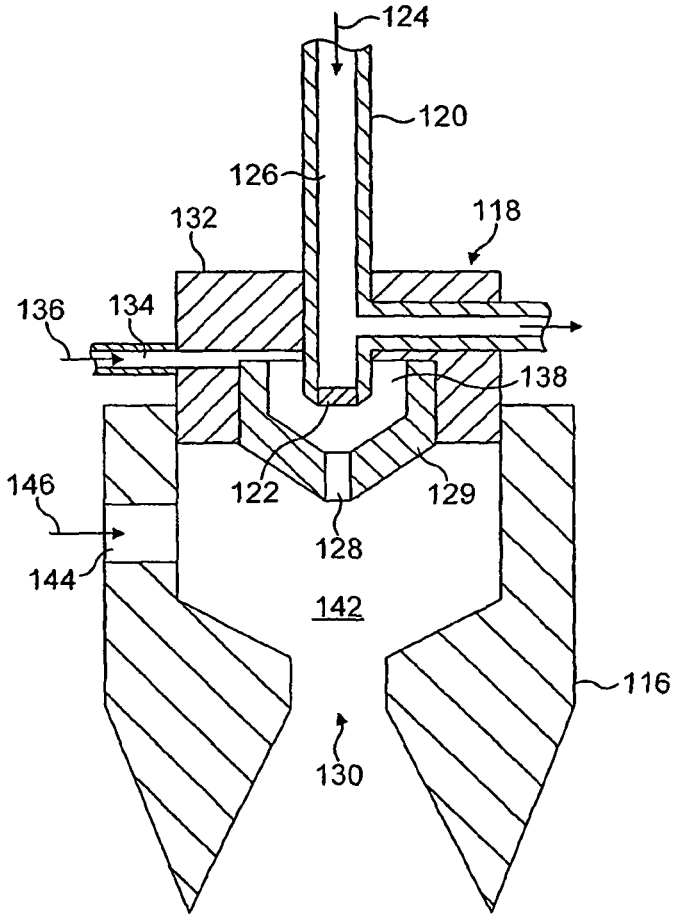
FIG. 3 illustrates one embodiment of a plasma generator of the pump of FIG. 2 in more detail.

A device in the form of a plasma generator 118 located upstream from the nozzle 116 forms the plasma ejected from the nozzle 116. In the preferred examples, the plasma generator 118 comprises a dc plasma torch 118. FIG. 3 shows in more detail the configuration of one arrangement for the plasma torch 118. The plasma torch 118 comprises an elongate tubular electron emitter 120 having an end wall 122. Water coolant 124 is conveyed through the bore 126 of the electron emitter 120 during use of the torch 118.

The bore 126 of the electron emitter 120 is aligned with a nozzle 128 formed in a start electrode 129 surrounding the end wall 122 of the electron emitter 120 and substantially co-axial with the aperture 130 of the nozzle 116 of the pump 100. The start electrode 129 is mounted in an insulating block 132 surrounding the electron emitter 120. A bore 134 formed in the block 132 conveys a stream of plasma source gas 136, for example, nitrogen or argon, into a cavity 138 located between the end wall 122 of the electron emitter 120 and the start electrode 129.

In operation of the plasma torch 118, a pilot arc is first generated between the electron emitter 120 and the start electrode 129. The arc is generated by a high frequency, high voltage signal typically provided by a generator associated with the power supply for the torch. This signal induces a spark discharge in the source gas flowing in the cavity 138, and this discharge provides a current path. The pilot arc thus formed between the electrode emitter 120 and the start electrode 129 ionises the source gas passing through the nozzle 128 to produce a high momentum plasma flame of ionised source gas from the tip of the nozzle 128. The flame passes from the nozzle 128 of the plasma torch 118 towards the nozzle 116 of the pump 10, which provides an anode for the plasma torch 118 and defines a plasma region 142. The nozzle 116 has a fluid inlet 144 for receiving a stream 146 of reactive fluid. In use, the reactive fluid is dissociated by the flame to form reactive species within the plasma region 142. These reactive species are thus emitted from the bore 130 of the nozzle 116 within the plasma flame.

Figure 4:
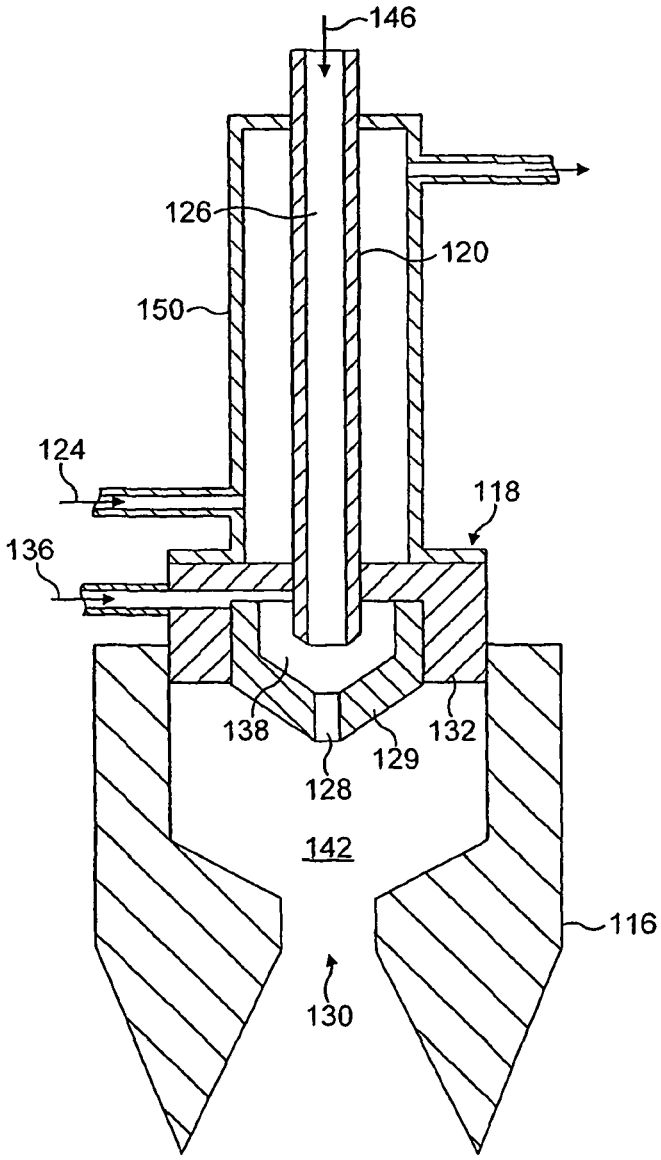
FIG. 4 illustrates another embodiment of a plasma generator of the pump of FIG. 2 in more detail.

FIG. 4 illustrates an alternative arrangement for generating the plasma stream. In this arrangement, the stream of reactive fluid 146 is conveyed directly to the plasma torch 118. As shown in FIG. 4, the reactive fluid stream is conveyed into the bore 126 of the electron emitter 120. The reactive fluid stream passes from the end of the electron emitter 120 into the cavity 138, where it is ionised by the plasma flame created from the source gas 136 to form a plasma stream containing the reactive species and which is injected from the nozzle 128 into the plasma region 142. In this arrangement, water coolant 124 is conveyed within a jacket 150 surrounding the electron emitter 120.

Figure 5:
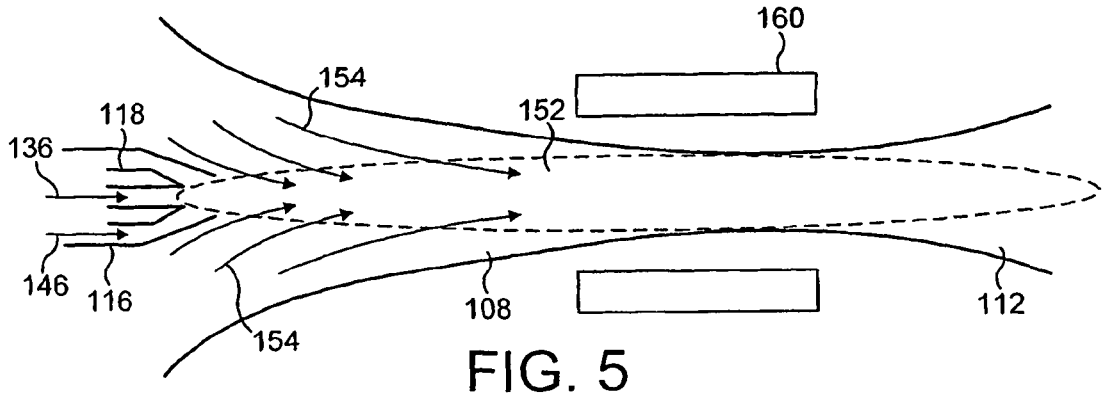
FIG. 5 illustrates schematically the plasma stream emitted from the nozzle of the pump of FIG. 2.

Returning to FIG. 2, the plasma stream thus generated by the plasma generator 118 is ejected from the nozzle 116 into the converging mixing portion 108 of the pump 100. As shown in FIG. 5, as the plasma stream 152 enters the mixing portion 108, the plasma stream 152 entrains and mixes with a gas stream 154 providing directional momentum to the total gas stream which passes through restriction 110. The reactive species within the plasma stream 152 can react with one or more of the components of the gas stream 154 to form different compounds. For example, where the reactive fluid is a source of $H^+$ and $OH^-$ ions, for example, water vapour, and the gas stream contains a perfluorocompound, for example, $CF_4$, the plasma generated by the plasma generator dissociates the water vapour into $H^+$ and $OH^-$ ions within the plasma region 142:

$$H_2O \rightarrow H^+ + OH^-$$

which ions subsequently react with the perfluorocompound within the body 102 of the pump 100 to form carbon dioxide and HF as by-products:

$$CF_4 + 2OH^- + 2H^+ \rightarrow CO_2 + 4HF$$

A typical gas mixture for performing a dielectric etch in a process tool may contain differing proportions of the gases $CHF_3$, $C_3F_8$, $C_4F_8$ or other perfluorinated or hydrofluorocarbon gas, but whilst the chemical reactions of the $H^+$ and $OH^-$ ions with these components of the gas stream will differ in detail, the general form will be as above.

As another example, where the reactive fluid is a source of $H^+$ and $OH^-$ ions, for example, water vapour, and the gas stream contains $NF_3$, the $NF_3$ becomes dissociated within the plasma to form $N_2F_4$, which reacts with the $H^+$ and $OH^-$ ions to form $N_2$ and HF:

$$4NF_3 \rightarrow N_2 + 4F_2 + N_2F_4$$

$$N_2F_4 + 2H^+ + 2OH^- \rightarrow N_2 + 4HF + O_2$$

As the plasma stream/gas stream mixture passes through the throat 110 of the body 102 and enters the diffuser portion 112, the velocity of the mixed stream is reduced, thereby increasing its pressure, typically by around 100 mbar when compared to the inlet pressure at 106.

As illustrated in FIG. 5, means 160 may be provided for generating a magnetic field to modify the shape of the plasma stream 152 to improve operating efficiency. The converging and diverging walls of an ejector pump are generally shaped to provide optimum efficiency only at a particular pressure, and so by modifying the shape of the plasma stream 152 independently from pressure, efficiency may be optimised over a range of pressures. The means 160 may be provided by a permanent magnet, electromagnets, current carrying coils, superconducting magnets or other suitable device or devices for generating the magnetic field.

Figure 6:
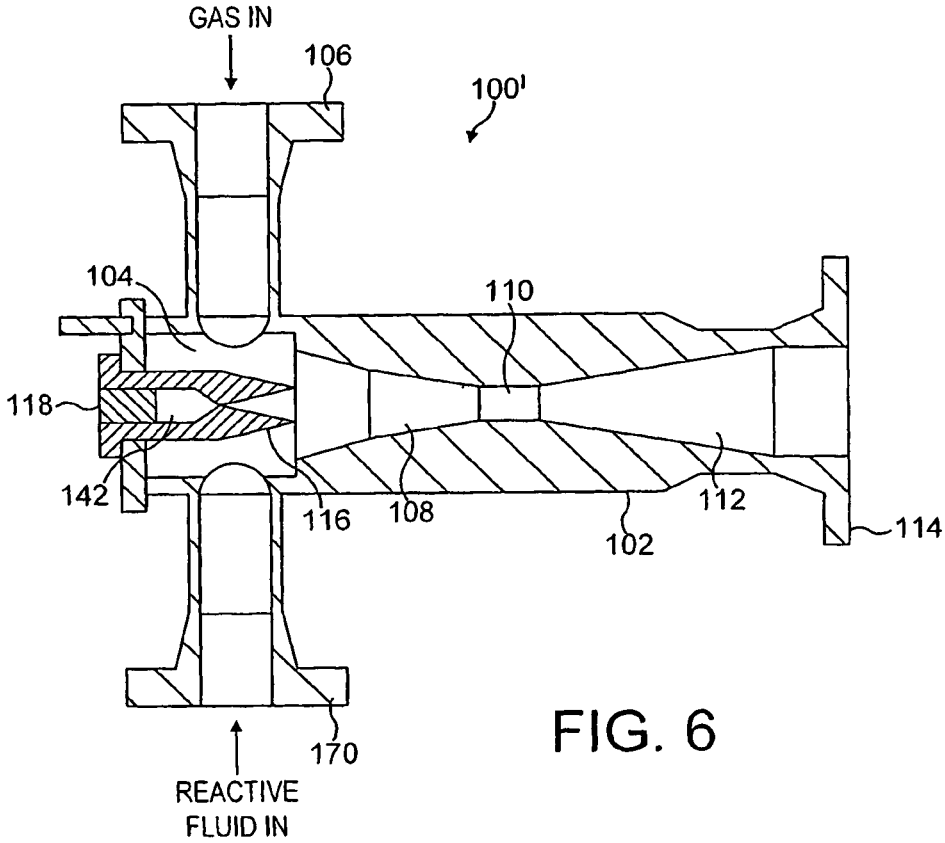
FIG. 6 illustrates schematically another example of an ejector pump according to the present invention.

FIG. 6 illustrates a second example of an ejector pump 100' in which a plasma stream is used as the motive fluid for the pump 100'. In this example, instead of the reactive fluid being conveyed to the pump upstream from the nozzle 116, as in the example described above, in this second example the reactive fluid is conveyed into the pump 100' from a second inlet 170 located downstream from the nozzle 116. In this second example, the plasma generator 118 may be similar to that shown in FIG. 3, with the exception that the inlet 144 is no longer required. Similar to the gas stream entering the pump 100' from the inlet 106, the reactive fluid is drawn through the inlet 170 due to the reduced pressure within the suction chamber 104. The reactive fluid becomes entrained within the plasma stream within the mixing chamber 108, wherein the reactive fluid dissociates into the reactive species for reaction with one or more of the components of the gas stream entering the pump 100' from the inlet 106.

Figure 7:
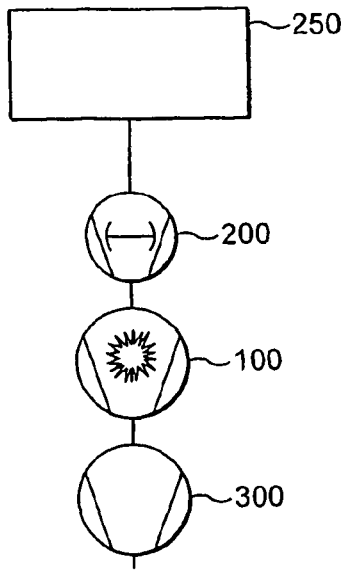
FIG. 7 illustrates a pumping arrangement including the ejector pump of FIG. 2 or FIG. 6.

FIG. 7 illustrates a pumping arrangement including the ejector pump 100 (or the ejector pump 100') for evacuating an enclosure. The ejector pump 100 is located downstream from one or more high capacity secondary or booster pumps 200 (one shown in FIG. 7, although any suitable number may be provided) each having an outlet connected to the inlet of the ejector pump 100 and an inlet connected to a respective enclosure 250.

Each secondary pump 200 may comprise a multi-stage dry pump, wherein each pumping stage is provided by a Roots-type or Northey-type or screw type or ball and socket type pumping mechanism. Alternatively, one or more of the secondary pumps 200 may comprise a turbomolecular pump and/or a molecular drag mechanism, or regenerative mechanism (with either a peripheral or a side wall pumping mechanism) depending on the pumping requirements of the respective enclosure 250.

The secondary pump 200 draw a gas stream from the enclosure 250 and exhausts the pumped gas stream at a sub-atmospheric pressure, typically in the range from 50 to 150 mbar to the ejector pump 100. The ejector pump 100 receives the pumped gas streams, converts one or more of the components of the gas stream into other components, and exhausts the pumped gas stream at a pressure of around 150 to 250 mbar depending the pressure of the gas exhaust from the secondary pump 200.

In the arrangement shown in FIG. 7, a backing pump 300 has an inlet connected to the exhaust of the ejector pump 100, the backing pump 300 pumps the gas stream exhaust from the ejector pump 100 and exhausts the gas stream to the atmosphere. Where the backing pump 300 is provided by a liquid ring pump, any components of the gas stream which are soluble within the pumping liquid of the liquid ring pump, which is usually water or other aqueous solution, are washed into the pumping liquid as the gas passes through the liquid ring pump. Consequently, the liquid ring pump operates as both a wet scrubber and an atmospheric vacuum pumping stage for the pumping arrangement.

As an alternative to providing a backing pump 300, the ejector pump 100 may be configured to exhaust the gas stream at or around atmospheric pressure. This will, however, require the density of the motive fluid within the ejector pump, and thus the density of the plasma flare, to increase, which would require a high powered plasma torch. Alternatively, or in addition, two or more ejector pumps 100 may be provided in series connection to one another or in parallel to increase capacity for receiving the gas stream exhaust from the secondary pump(s) 200 and exhausting the gas stream at atmospheric pressure. The gas stream is subsequently conveyed to a wet scrubber to take the HF into aqueous solution, or to a solid reaction media for reaction with the HF to form a solid by-product which can be readily disposed of.

While the foregoing description and drawings represent the preferred embodiments of the present invention, it will be apparent to those skilled in the art that various changes and modifications may be made therein without departing from the true spirit and scope of the present invention.

I claim:

1. A pumping arrangement comprising:

a backing pump; and an ejector pump comprising:

a chamber having a gas mixing portion and a diffuser portion, an inlet for conveying a gas stream into the gas mixing portion, an outlet for conveying the gas stream from the diffuser portion, and a gas abatement device for ejecting a stream of plasma through a nozzle into the gas mixing portion of the chamber to provide a motive fluid for the ejector pump and decompose a component of the gas stream, wherein the gas abatement device comprises the nozzle, means for generating a plasma from a source gas, and means for receiving a stream of reactive fluid which impinges upon the plasma to form within the plasma reactive species for reacting with the component of the gas stream, and wherein the backing pump has an inlet connected to the outlet of the ejector pump.

2. The pumping arrangement of claim 1, wherein the plasma stream ejected through the nozzle contains reactive species for reacting with the component of the gas stream.

3. The pumping arrangement of claim 1, wherein the source gas comprises an inert ionizable gas.

4. The pumping arrangement of claim 1, wherein the pump comprises a second inlet for receiving a stream of reactive fluid for becoming entrained within the plasma stream and forming within the plasma stream reactive species for reacting with the component of the gas stream.

5. The pumping arrangement of claim 4, wherein the reactive fluid becomes entrained within the plasma stream upstream from the nozzle.

6. The pumping arrangement of claim 1, wherein the gas abatement device further comprises means for generating from the reactive fluid a plasma containing reactive species for reacting with the component of the gas stream.

7. The pumping arrangement of claim 2, wherein the reactive species are chosen to convert a component of the gas stream into a different compound.

8. The pumping arrangement of claim 2, wherein the reactive species are chosen to convert a water-insoluble component of the gas stream into a water-soluble component.

9. The pumping arrangement of claim 2, wherein the reactive species are chosen to convert a perfluorinated or hydrofluorocarbon component of the gas stream into a water-soluble component.

10. The pumping arrangement of claim 2, wherein the reactive species comprises at least one of $H^+$ ions and $OH^-$ ions.

11. The pumping arrangement of claim 1, wherein the gas abatement device comprises a dc plasma torch for generating the plasma.

12. The pumping arrangement of claim 1, further comprising means for shaping the plasma stream ejected from the nozzle.

13. The pumping arrangement of claim 1, further comprising at least one device for generating a magnetic field for shaping the plasma stream ejected from the nozzle.

14. The pumping arrangement of claim 1, wherein the backing pump comprises a liquid ring pump for receiving the gas stream from the ejector pump and removing one or more liquid-soluble components from the gas stream.

15. The pumping arrangement of claim 1, further comprising a booster pump having an outlet connected to the inlet of the ejector pump.

* * * * *